US008569608B2

(12) United States Patent
Moon

(10) Patent No.: US 8,569,608 B2
(45) Date of Patent: Oct. 29, 2013

(54) ELECTRONIC HARP

(76) Inventor: Michael Moon, Hamilton (CA)

( * ) Notice: Subject to any disclaimer, the term of this patent is extended or adjusted under 35 U.S.C. 154(b) by 0 days.

(21) Appl. No.: 13/516,946

(22) PCT Filed: Nov. 17, 2010

(86) PCT No.: PCT/CA2010/001989

§ 371 (c)(1),
(2), (4) Date: Jun. 18, 2012

(87) PCT Pub. No.: WO2011/072385

PCT Pub. Date: Jun. 23, 2011

(65) Prior Publication Data

US 2012/0272813 A1 Nov. 1, 2012

Related U.S. Application Data

(60) Provisional application No. 61/287,442, filed on Dec. 17, 2009.

(51) Int. Cl.
*G10H 3/06* (2006.01)

(52) U.S. Cl.
USPC ..... 84/724; 84/264

(58) Field of Classification Search
USPC ..... 84/724, 264–266
See application file for complete search history.

(56) References Cited

U.S. PATENT DOCUMENTS 1,865,428 A * 7/1932 Bethenod ..... 84/702
3,958,113 A 5/1976 Termohlen
4,321,463 A * 3/1982 Stecher ..... 250/227.19
4,429,607 A 2/1984 Meno
4,653,376 A * 3/1987 Allured et al. ..... 84/646
4,688,460 A * 8/1987 McCoy ..... 84/724
4,690,026 A * 9/1987 McCoy ..... 84/603
4,744,280 A * 5/1988 Garritano ..... 84/726
4,968,877 A * 11/1990 McAvinney et al. ..... 250/221
5,012,086 A * 4/1991 Barnard ..... 250/222.1
5,014,588 A * 5/1991 Omata et al. ..... 84/726
5,014,589 A * 5/1991 Obata ..... 84/735
6,153,822 A * 11/2000 Toba et al. ..... 84/724
6,175,074 B1 * 1/2001 Takahashi et al. ..... 84/724
6,803,512 B2 * 10/2004 Ishida et al. ..... 84/633
7,598,450 B2 * 10/2009 Meeks ..... 84/727
7,799,986 B2 * 9/2010 Ryle et al. ..... 84/737

(Continued)

FOREIGN PATENT DOCUMENTS

EP 0110152 6/1984

OTHER PUBLICATIONS

Canadian Intellectual Property Office as International Searching Authority, International Search Report and Written Opinion for International patent application No. PCT/CA2010/001989, Mar. 14, 2011.

(Continued)

*Primary Examiner* — David S. Warren
(74) *Attorney, Agent, or Firm* — Borden Ladner Gervais LLP; Jeffrey W. Wong

(57) ABSTRACT

A harp comprising a body, a set of strings attached to the body, an optical pickup to generate an analog signal produced by the vibration of a string within the set of strings, at least one circuit board to convert the analog signals to a corresponding digital signal, wherein the digital signal is then processed.

12 Claims, 10 Drawing Sheets

(56) References Cited

U.S. PATENT DOCUMENTS

| | | | | |
|---|---|---|---|---|
| 7,812,244 | B2 * | 10/2010 | Kotton et al. | 84/724 |
| 7,977,566 | B2 * | 7/2011 | Haddad | 84/724 |
| 8,067,683 | B2 * | 11/2011 | Meeks et al. | 84/622 |
| 8,071,870 | B1 * | 12/2011 | Bailey et al. | 84/724 |
| 8,129,607 | B2 * | 3/2012 | Loftus | 84/723 |
| 8,242,346 | B2 * | 8/2012 | Haddad | 84/724 |
| 2002/0005108 | A1 | 1/2002 | Ludwig | |
| 2003/0230187 | A1 * | 12/2003 | Ishida et al. | 84/741 |
| 2006/0011048 | A1 * | 1/2006 | Koster | 84/723 |
| 2006/0075879 | A1 * | 4/2006 | Ushinski | 84/464 A |
| 2006/0107826 | A1 * | 5/2006 | Knapp et al. | 84/724 |
| 2006/0150806 | A1 * | 7/2006 | Hara | 84/726 |
| 2007/0227344 | A1 * | 10/2007 | Ryle et al. | 84/723 |
| 2008/0282873 | A1 * | 11/2008 | Kotton et al. | 84/645 |
| 2009/0223353 | A1 * | 9/2009 | Loftus | 84/726 |
| 2010/0005954 | A1 * | 1/2010 | Higashidate et al. | 84/725 |
| 2010/0011942 | A1 * | 1/2010 | Wessels | 84/724 |
| 2010/0263521 | A1 * | 10/2010 | Ierymenko et al. | 84/726 |
| 2011/0061517 | A1 * | 3/2011 | Haddad | 84/724 |
| 2011/0132180 | A1 * | 6/2011 | Gobbers | 84/622 |
| 2011/0265635 | A1 * | 11/2011 | Haddad | 84/724 |
| 2012/0234161 | A1 * | 9/2012 | Haddad | 84/724 |
| 2012/0266740 | A1 * | 10/2012 | Hilbish et al. | 84/645 |
| 2012/0272813 | A1 * | 11/2012 | Moon | 84/645 |
| 2012/0304848 | A1 * | 12/2012 | Haddad | 84/724 |

OTHER PUBLICATIONS

European Patent Office, Extended European Search Report for European Patent Application No. 10836888.7, Nov. 14, 2012.

* cited by examiner

*The Harpella - Figure 1a*

*Harpella - Figure 2*
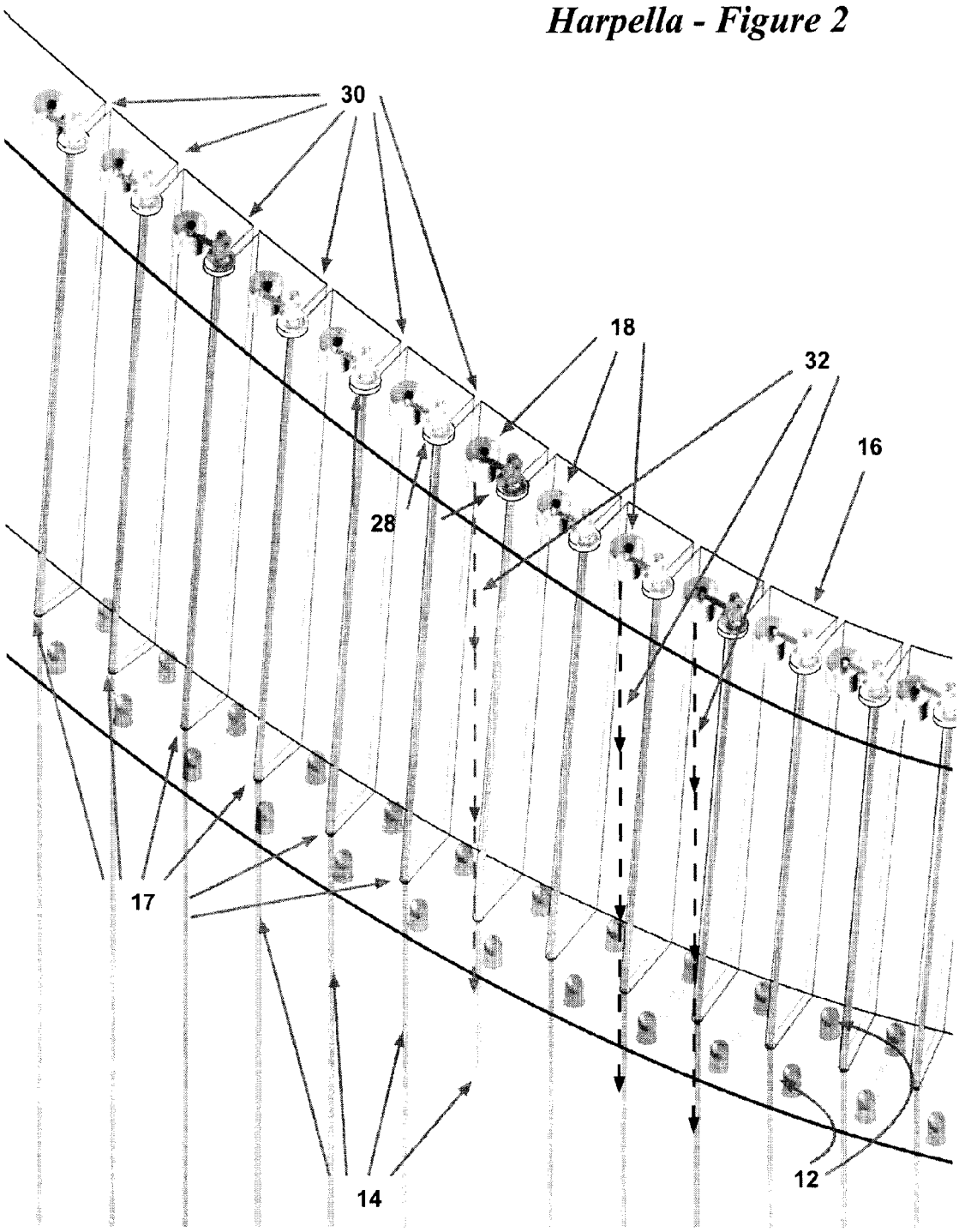

Harpella - Systems Diagram - Figure 6

*Harpella - Sound Processing Circuit Diagram - Figure 7*

*Harpella - Light Controller Circuit Diagram - Figure 8*

ELECTRONIC HARP

CROSS REFERENCE TO RELATED APPLICATIONS

This application claims the benefit of priority of U.S. Provisional Patent Application No. 61/287,442 filed Dec. 17, 2009, which is incorporated herein by reference in its entirety.

FIELD

This disclosure relates to a harp. More particularly, this disclosure describes an electronic harp system.

BACKGROUND

Typically, conventional harps have used a series of levers on each individual string or a set of pedals to mechanically alter the pitch of the strings to enable the instrument to be played in a given key signature. Where complex key changes occur in compositions, the ability of the harp to be retuned within a reasonable amount of time limits what is physically possible to play. Consequently, certain key changes can be difficult to accomplish during certain compositions limiting music selection and style.

Conventional harps may further require the engaging or disengaging of a pedal or lever to physically change the tension of the strings. In the case of a conventional concert harp, foot pedals can only change two of seven like-letter named strings at a time rendering it, in many cases, difficult or impossible to make instantaneous changes to certain keys. Although the levered harp can change the pitch of individual strings, it is cumbersome to change keys due to the very fact that each individual string requires a lever to be flipped for each sharp or flat in a given key and octave.

Learning to manipulate the levers or pedals on a harp is difficult due to the complicated nature of mechanisms and the music theory required. These mechanisms may also require fine-tuning and the service of a technician, from time-to-time, to keep the instrument functioning properly. These mechanisms also have contributed to the high cost of harps.

Another limitation in conventional harps may be their difficulty to transport. A harp with a sound box and tuning mechanisms is heavy and bulky making transport difficult.

SUMMARY

It is therefore desirable to have an electronic harp that overcomes at least some of the disadvantages of conventional harps.

In one aspect, there is provided an electronic harp having a new system of electronic switching and digital pitch shifting that allows for instantaneous change of pitch of individual strings at the touch of a single button on a touch screen or foot pedal.

In another aspect, there is provided a method of changing the pitch of the strings does not depend on physically altering the string as is the case with conventional harps. The harp of the current disclosure, due to its electronic pitch shifting system, which makes it possible to not only change keys instantly at the touch of one controller, but also can vary the pitch of each string independently, allowing for unusual tunings never before possible (i.e. pentatonic scales in any key, blues scales, harmonic minor scales etc.). MIDI messages can be sent to the harp to automatically change the pitch of individual strings so that when playing along with a MIDI arrangement all key changes can be rapidly accomplished without the need for the musician to manually make these changes.

BRIEF DESCRIPTION OF THE DRAWINGS

Embodiments of the present disclosure will now be described, by way of example only, with reference to the attached Figures, wherein:

FIG. 1*a* is a side profile illustrating one embodiment of an electronic harp;

FIG. 2 illustrates a close up section of the top of the harp;

DETAILED DESCRIPTION

Figure 1B:
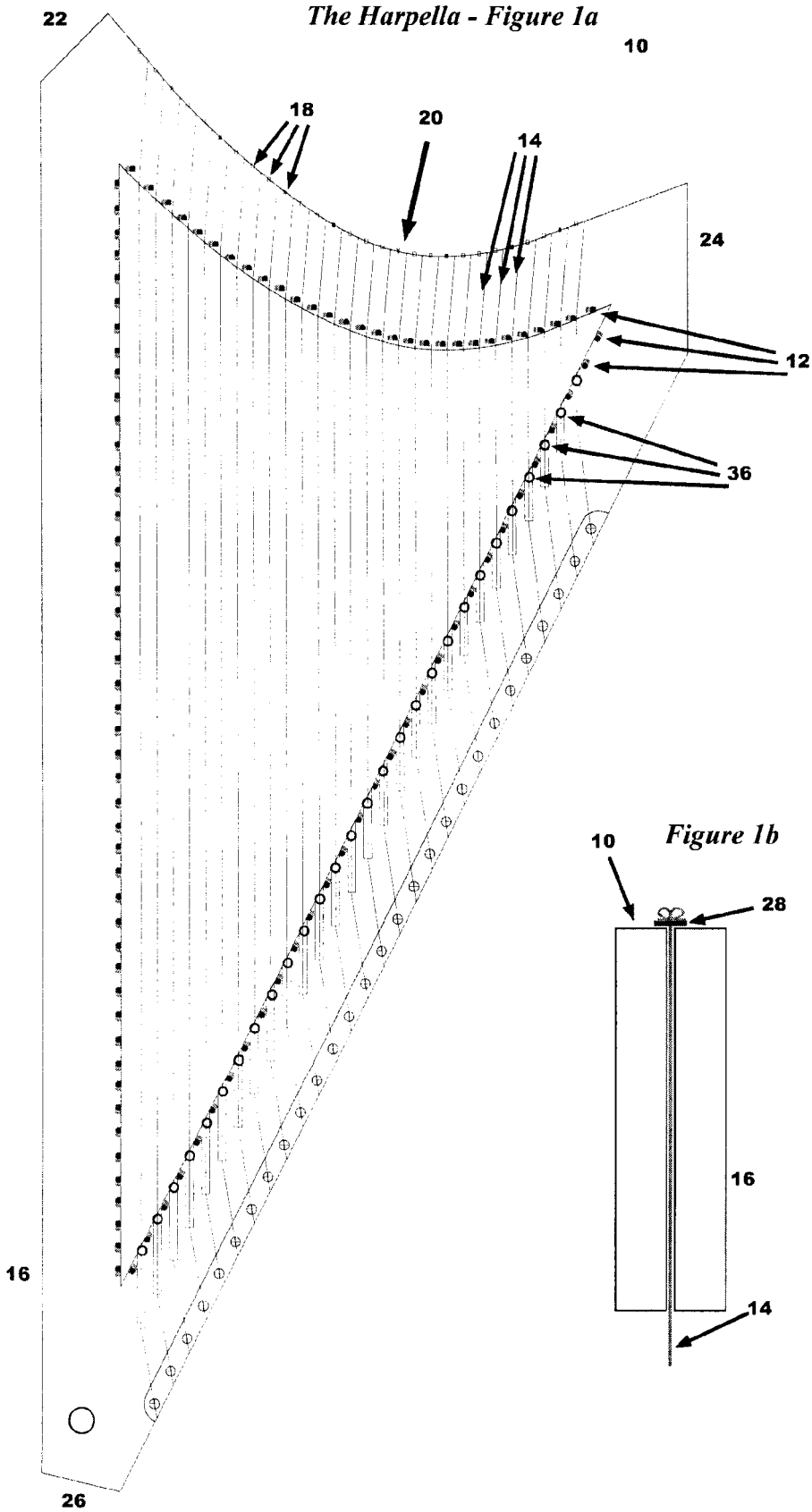
FIG. 1*b* is a rear profile of the harp.

Generally there is provided a harp that is Musical Instrument Digital Interface (MIDI) functional and can send note information to a synthesizer or sequencer. The electronic harp may be used in a conventional playing manner with the addition of visual elements. The electronic harp may further be used in various operating modes, such as a light mode or an automatic chord mode.

One embodiment of the electronic harp is shown in FIG. 1. The electronic harp (10) uses lights in combination with an optical pickup (36) to detect the vibration of strings (14). In one case, the harp (10) has a clear acrylic V-shaped body (16), which may take on a prism-like appearance when lit by body lights, such as LEDs (12). Other colours and materials are considered for the body, such as ultra high molecular weight plastic or carbon fiber may also be used. The LEDs (12) may be individually addressed, or sets of the LEDS may be addressed for communication with a processor. The LEDs may comprise seven bands of colour corresponding to the colours of the spectrum. In other cases, the LEDs (12) may all be a single colour, a tri-colour combination or other arrangement. In one case, the LED colour bands may be mapped to the audio spectrum so that the lower sounds light the body (16) of the harp with the low end of the visual light spectrum (red-orange-yellow) and the high end of the audio spectrum lights the high end of the visual spectrum (green-blue-indigo-violet). One channel of white LEDs may also be available. This body light feature is intended to add a visual element to the performance of harp, and may incorporate lasers or other lights as opposed to LEDs. The operation of the LEDs is further described below.

The body (16) of the harp (10) is designed to further allow for the projection of a string light (18) down the length of each individual string (14) as the strings (14) are offset and the lighting may result in an effect similar to fiber optics. The string lights (18) may be low powered lasers, LEDs or other projecting lights, and may light each string (14) with colours typical of conventional harp string colours, such as blue for the note F, red for the note C and white for the remainder of the strings. Other colour arrangements are possible, for example all strings being lit blue or green for example. Lighting the strings (14) may not only add another visual element but may also provide the harpist a clear place indicator when playing notes that is highly beneficial in low light settings.

At the top of the V-shaped body is a harmonic curve (20) typical of conventional harps. This curve varies at a rate that facilitates the proper length needed for each sequential string for the appropriate pitch.

The V-shaped body (16) has two upper corners (22, 24). These corners (22, 24) are designed to be cut at an angle that is intended to improve the strength of the harp but also allow for a compact carrying case. The corners (22, 24) may aid in minimizing the width of the instrument compared to the corners of a conventional harp, without compromising on the strength of the instrument or adding unnecessary weight. These angles may also help to reflect coloured light inward, for example, back into the body of the instrument from the LEDs positioned around the inside perimeter of the body (16). The V-shaped body (16) further comprises a bottom corner (26), which may be mounted on a removable base (shown in FIG. 5) that is intended to help balance the harp (10).

FIG. 1*b* illustrates a top rear view of the harp (10). From the rear view, it can be seen how the strings (14) are strung. Preferably, the strings (14) are strung down the center of the depth of the electronic harp (10). For example, if the body (16) of the harp (10) is an inch in thickness, the string (14) may be located with approximately a half an inch on either side. As the electronic harp does not need to accommodate conventional tuning mechanisms, the harp (10) can benefit from centrally hung strings (14). This design, due to the manner in which the sound from the string (14) is digitally pitched up or down, is indented to be a simpler design, thereby reducing production costs. Because the tension of the strings is centered on the body, rather than on one side as in a traditional harp, which may tend to twist the frame, less material may be needed to keep the frame rigid, minimizing the overall size and weight of the harp (10). The strings (14) may be held in place at the top of the harp (10) by knotting the string above a stopper (28). Other stopping mechanisms may also be used, for example, a molded plastic end or fusing a plastic stopper onto the end of the string (14).

FIG. 2 shows a close up section of the top of the harp. In one embodiment, the body (16) of the instrument may be made from acrylic with a plurality of channels (30) used to accommodate the strings (14). There are various ways the channels (30) may be fabricated, including, for example, cut with a router. As can be seen from FIG. 2, the channels (30) may be slightly offset from a string entry point. This offset channel (30) allows for the string to have a fixed point (17) at an edge of the body (16), which facilitates the vibration of the string over a length dictated by the width of the body at that specific point. This design feature is not seen in conventional harps, which tend to require a side-mounted pin of some kind to give the string an accurate fixed point to be strung over. This mounting design is intended to save manufacturing time and adds mechanical simplicity to the design. In one case as illustrated in FIG. 2, the string (14) enters the channel (30) and body (16) and is knotted above the stopper (28) to prevent the string from being pulled back through the body (16).

FIG. 2 also illustrates further details in the mounting of the string lights (18). Each string light (18) may point down the length of the corresponding string (14). The dotted arrows (32) on FIG. 2 indicate the path of the light. As mentioned above, the string lights (18) may be configured to identify the strings (14) as in a conventional harp, for example red for the tone 'C', blue for the tone 'F' and white for all the other tones, and is also intended to provide the harpist with greater string visibility, especially in low light conditions. The string lights (18) may be accurately aimed down the length of the string (14) through the manner in which the channel (30) is offset and also due to the material of the body (16). The mounting arrangement with the addition of a clear frame may allow the light to pass directly through the body (16) and down the length of the string. The illumination of the strings further aids the harp (10) when operating in other modes, such as a light mode or an automatic chord mode, as detailed below.

The body lights, which are shown as LEDs (12), are mounted on the inner perimeter of the body (16) as illustrated in FIG. 2. A channel (not shown) may be cut in the inner perimeter of the body (16) to provide a path for the connectors (34), for example wires, for the string lights (18) and the LEDs (12). The connectors (34) may be provided with external power provided through the base, shown in FIG. 5. The connectors for the string lights (18) may follow the path made by the top-channels, then along the channel in the inner perimeter of the top and front of the frame. The LEDs (12) may be wired so that each set can illuminate the frame with any combination of individual colours at any place around the frame. This configuration will allow for a ligh mode that will light the front part of the frame with one colour, the middle section with another colour and the back part of the frame with a different colour. Other lighting arrangements are also contemplated.

Figure 3:
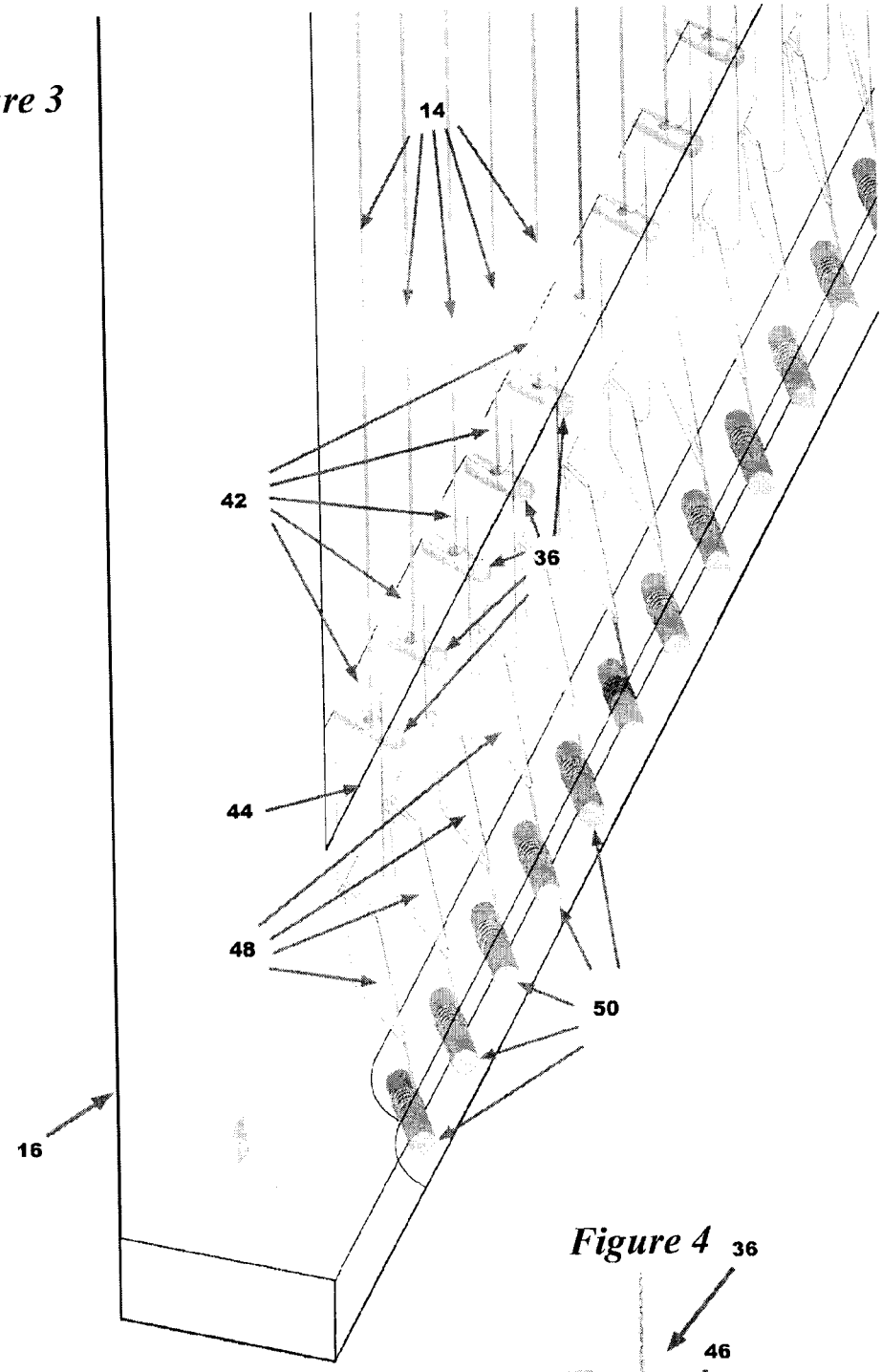
FIG. 3 illustrates a close up of the lower section of the harp.

FIG. 3 illustrates the bottom of the v-shaped body (16) of the harp (10). The strings (14) enter the top part of the lower body (16) through apertures (42) into a vibration area (44) that has sufficient clearance to allow for the strings (14) to vibrate freely. At this point the optical pickups (36) are mounted across the apertures (42) and the strings (14) enter and exit through a housing (46) on each individual optical pickup (36). At the bottom of the vibration area each string (14) enters into separate offset bottom channels (48) in the body (16). The bottom channels (48) are offset to allow the strings (14) to have a fixed point to be stretched across, similar to the top of the frame. These design elements may be beneficial as the strings (14) require a minimum amount of clearance from the body (16) to vibrate sufficiently in order to register at each optical pickup (36). It may be impractical to mount the optical pickup (36) at a fixed point on the bottom of the body (16) as this may not allow for sufficient vibration for the optical pickup (36) to function properly. The vibration area (44) is intended to address this issue.

Below the offset bottom channels (48), the strings (14) are wound around tuning pegs (50), where the strings (14) can be tightened to the correct tension to tune the strings (14) to the required pitch. The tuning pegs (50) may be tapered, unlike tuning pegs in a conventional harp, corresponding to the holes in which the tuning pegs (50) are mounted. However, the pegs may also be untapered. Having the tuning pegs (50) tapered may assist the harpist when turning the pegs as the tuning pegs are intended to stay in the position they are turned to due to friction created when the pegs are pushed into the tapered hole. This design may not only accommodate the mounting of the lights and optical pickups, but may also make it simpler to tune the instrument as the harpist will not need to reach up to tune the instrument. The tuning pegs (50) are intended to be more accessible when located at the bottom of the body (16).

Figure 4:
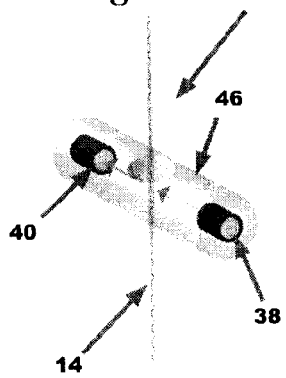
FIG. 4 illustrates an optical pickup system according to one embodiment.

The electronic harp (10) makes use of light to provide functionality as well as a further visual component to the instrument. A series of optical pickups (36) is further included on the harp (10), as shown in FIGS. 3 and 4. The optical pickups (36) are operatively connected to each individual string (14), and further connected to a graphical user interface and a processor, via for example a computer, described in further detail below. The optical pickups (36) use a processing system, wherein an LED source (38) projects a beam of ultraviolet light across each string (14) and a matched LED receiver (40) detects the variation of the ultraviolet light. The variation of light is intended to provide an image of the vibration of the string (14). This image provided by the variation of light becomes an electronic signal that is converted to a digital signal and fed to the processor based on a switching matrix that channels each individual signal through a digital pitch shifter and is ultimately changed back into an analog signal and recombined as a final output, as described below. In one embodiment, the optical pickups (36) are intended to provide improved fidelity as well as solve the problem of audio feedback inherent with using a microphone on a live harp with a sound box. Piezo-type pickups are not needed, which tend to be more expensive, nor are wire-wound pickups typical of electric guitars. The system provides the ability to access key changes and special tuning modes.

FIG. 4 shows the optical pickup (36) in detail. The strings (14) pass through the top of the housing (46) of the individual optical pickups (36) and exit the bottom. On one side of each optical pickup the LED (38) generates ultraviolet light that is directed at the string (14). This LED produces light at a frequency that is in a very narrow band. As the string (14) vibrates, the string (14) varies the light as the light passes toward the matched LED receiver (40) that responds only to that narrow band of ultraviolet light. The optical pickup (36) is connected by an electrical current that is present on one side of the LED receiver (40). As the varying ultraviolet light enters the LED receiver (40), the current that can pass through the LED receiver (40) also varies. This is a characteristic of a matched set of ultraviolet LEDs. This current variation is further amplified using operational amplifier (op-amp) chips and is then converted to a digital signal using analog to digital conversion circuits, described in further detail below. These digital signals from each individual string (14) are merged and conveyed to the processor to be processed and ultimately converted back to an analog signal, which is amplified in order to be heard by the harpist and their audience. The optical pickup (36) is intended to be less expensive than a conventional Piezo pickup, although a Piezo pickup may also be used to produce an analog signal from the string.

Figure 5:
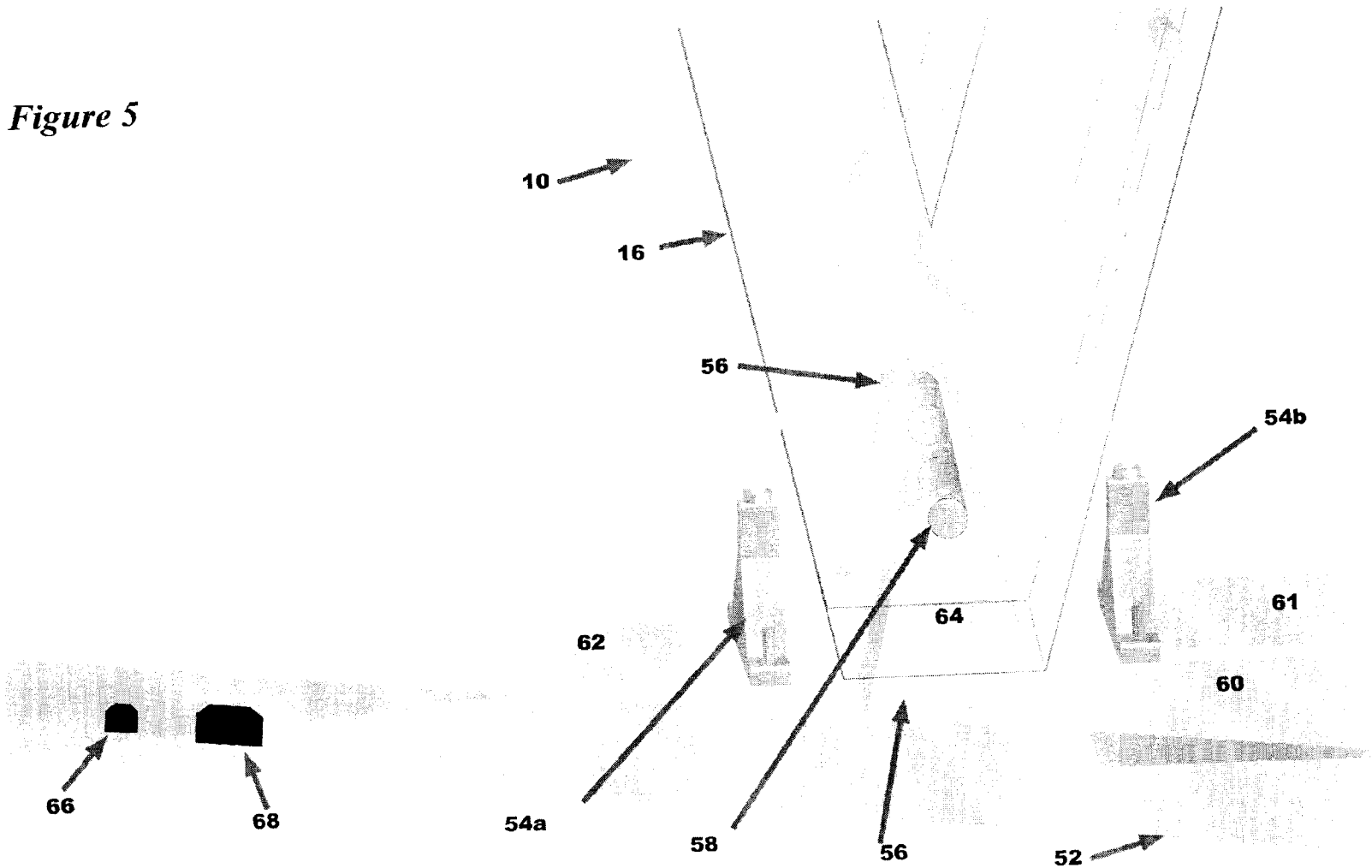
FIG. 5 illustrates a base of the harp.

FIG. 5 illustrates a removable base (52) and a possible wiring arrangement for the harp (10). The base (52) may house the circuitry of the electronic harp (10). The wiring is operatively connected to at least one multi-pinned connector (54*a*, 54*b*) that connects to the base (52). The base (52) may be triangular in shape with the base of the triangle facing the harpist when he/she sits behind the harp. Other shapes of the base (52) of the harp are also contemplated. The base (52) is intended to provide a sturdy platform so that the harp may stand upright when not being played. The design of the base may also enable the harpist to tilt the harp back onto the harpist's shoulder as is the customary position.

The harp base (52) may further include at least one mounting bracket (56) and, in one embodiment, a mounting bracket on either side of the harp body (16). The mounting brackets (56) may rise from the base and secure the harp body (16) onto the base (52). In one case, a removable pin (58) may be inserted through the mounting brackets (56) and the harp body (16), and may hold the base (52) securely to the harp (10). This pin (58) is designed to be removable as is the multi-pinned connector so that the base (52) may be removed when the harp is being transported. Other connectors besides a pin are contemplated, for example a threaded nut and bolt arrangement.

FIG. 5 also shows the positioning of circuit boards (60, 61, 62, and 64). Circuit boards may be included for each of the functions as follows: Analog to Digital Conversion Circuit and Merging of Digital Signal Circuit; Computer Interface Circuit; String Light Control Circuit; and LED Control Circuit or the circuits may be included onto a single circuit board. The base (52) may further contain a Universal Serial Bus (USB) port (66), where an external computer with processing power may be connected, and a power supply connection (68) to provide power to the electronic harp. Instead of a USB port (66) other connecting ports are considered, for example a serial port. Alternatively, Bluetooth connectivity may be provided.

Figure 6:
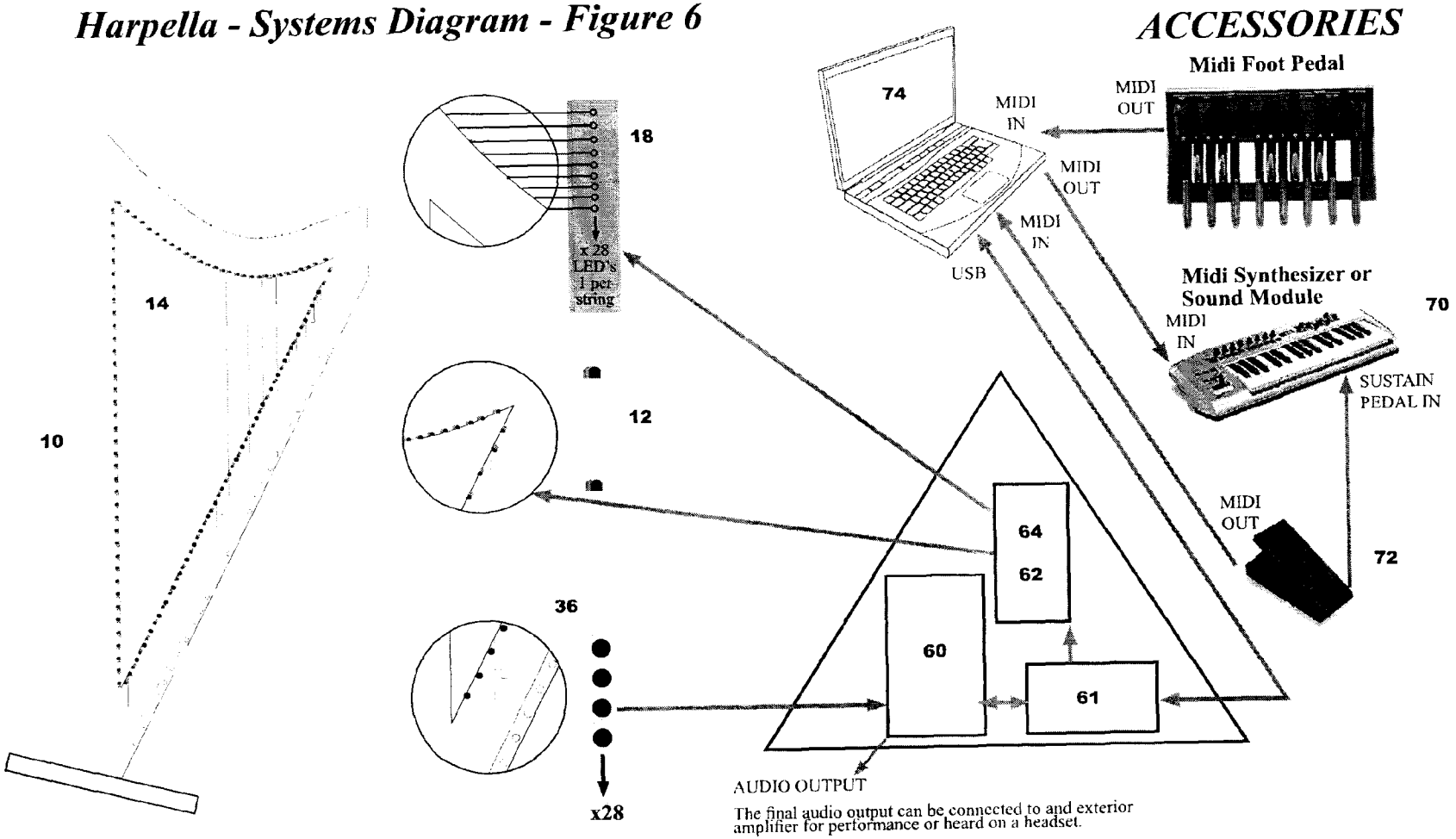
FIG. 6 is a systems diagram detailing the flow of signals and connection of various components.

FIG. 6 illustrates an overall systems diagram of the electronic harp (10). The electronic harp (10) is Musical Instrument Digital Interface (MIDI) functional and can send note information to a synthesizer (70) or sequencer or the like. When accessing a synthesizer (70), any preset voice can be triggered by the harp (10) on an assigned MIDI channel. This feature may allow the harp (10) to play with a synthesized sound doubling the individual harp strings (14) that are plucked. Also, with a pedal (72), notes can be played to trigger the synthesizer forming chords that are sustained. The system may also employ a voice activated trigger or system instead of or in addition to the pedal (72). The harpist continues to play with the chords sustained in the background; however, additional note information is temporarily discontinued while the pedal (72) is engaged so as to avoid unwanted notes from sounding.

The electronic harp (10) may further allow the harpist to select colours of the string lights (18) and LEDs (12), through a graphical user interface on the computer (74), for example, through a touch screen or through MIDI controls. The harpist may select to light the harp (10) at a given moment, or to turn off the lights (12, 18). For live stage shows, the feature of MIDI controlled illumination of the electronic harp (10) makes for a dynamic visual experience. The light features may also allow for the coordination of other stage lighting that has been programmed via MIDI to produce a synchronous sound and light experience of both the instrument and the surrounding environment.

When utilizing a MIDI sequencer, the sound of the harp can be played back through a module that is a sampled version of the actual electronic harp (10). This allows for real-time live recording and playback of multiple layers of the harp's sound in a loop as well as what appears to be a "self-playing" feature.

The systems diagram in FIG. 6, illustrates one embodiment of components of an electronic harp system including an electronic pitch shifting system, which are as follows:

1. the harp (10) and the individual strings (14);
2. an optical pickup (36) on each string providing an analog signal generated by the vibration of each string;
3. at least one circuit board that has electrical components that convert the analog signals to digital signals and prepares those signals for processing; and
4. a processor, most commonly in the form of a computer, that sends control commands to the digital processing circuitry, where methods for controlling the electronic pitch shifting system, described below. The computer provides an interface with the user that allows for the control of the functionality of the electronic harp (10).

The final output is heard at the computer's audio output taken from the digital to analog converters present on the computer or can be processed through an external sound conversion module (this may be recommended as external digital to analog conversion modules typically are of a higher quality than those normally resident on conventional computers). In another embodiment, the final output may be heard as an output from the Digital to Analog sound processor (60). This output may be in the form of a stereo output of two channels or could also be a mono output or be configured for a multiple output as is the case in Surround Sound or the like.

In application, when each string is plucked, the optical pickup (36) provides individual signals for the vibration. These signals are then relayed to the analog to digital conversion circuit and sent to a digital sound processing circuit (60). The computer (74) provides an interface where commands controlling the digital sound processing circuits (60) are sent via USB or other connection. The computer, or processor, (74) also provides an interface where commands controlling the string lights are processed and then sent to the string light control circuit (64). In a similar fashion, signals controlling the body light LEDs (12) are also sent from the computer (74) to interface circuit (61) then to the body light control circuit (62). It will be understood that the signals may travel in either direction, from the computer to the electronic harp (10), or from the harp (10) to the computer (74).

Figure 7:
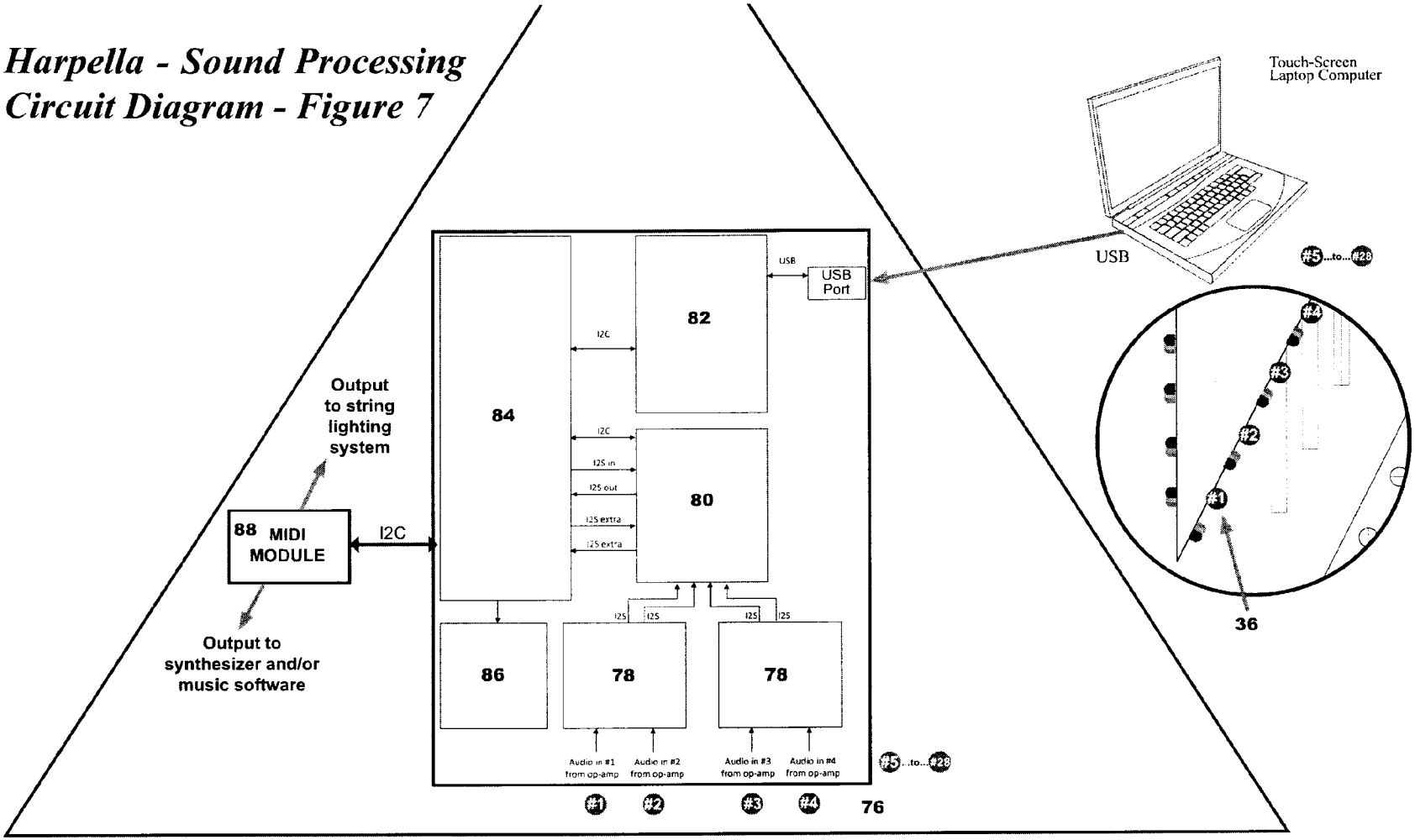
FIG. 7 illustrates a sound processing circuit diagram.

FIG. 7 further illustrates the sound processing of the electronic harp (10). The sound for each string (14) is picked up and converted to an electrical signal by the optical pickups (36). The signals are individually related to audio inputs through op-amps (76). The signals are then converted to digital signals using an analog to digital converter (78) that may be located within the analog to digital conversion and merging of digital signal circuits (60). The digital signals may then be processed using digital signal processing (DSP) at the DSP module (80) through a plurality of DSP processors within the DSP module (80). The plurality of DSP processors may be used to pitch the signals to the correct sharps or flats for a given key signature or scale. In the alternative, the signal could be muted if required. The digital signal processing module (80) may contain jumpers to configure which notes are being processed and various audio inputs, audio bus inputs and audio bus outputs.

The digital signal processing module (80) is operatively connected to a USB module (82) via hardware bus elements (84). The digital signal processing may be controlled via the processing power and systems located on the operatively connected computer (74). It will be understood that the USB module (82) that currently transmits the signals to and from the computer and electronic harp (10) may be another connection module, for example WIFI or Bluetooth. The USB module (82) receives commands via USB and transmits these commands through the hardware bus elements (84). The USB module (82) may request information from a specific slave DSP processor within the DSP module (80). The USB module (82) receives communication from the computer (74) and transmits commands to the hardware bus elements (84) via Inter-Integrated Circuit (I2C) communication protocol between the integrated circuits. The hardware bus elements (84) provide the physical connection from the plurality of digital sound processors located within the DSP module (80). The hardware bus (84) may further provide the power to each DSP processor and DSP module (80).

Once the digital signals have been processed they may be combined to form a single stereo out in the audio out component (86). Alternatively, once the digital signals have been processed they may be combined to form a stereo output of two channels or could also be a mono output or be configured for a multiple output as is the case in Surround Sound or the like. The digital to analog converter, part of the audio out component (86), outputs an analog audio signal, which can be amplified for a sound system, headphones, or similar devices. The digital output may be transferred to the MIDI module (88), which may analyzed and convert the digital output into MIDI data for output. The MIDI module (88) may further output information with respect to the lighting information for the LEDs (12) and string lights (18). The output may be captured by a MIDI sequencer for later playback or may be used for triggering notes on a synthesizer during a live performance to create a doubling of the sound of the harp and the synthesizer.

Figure 8:
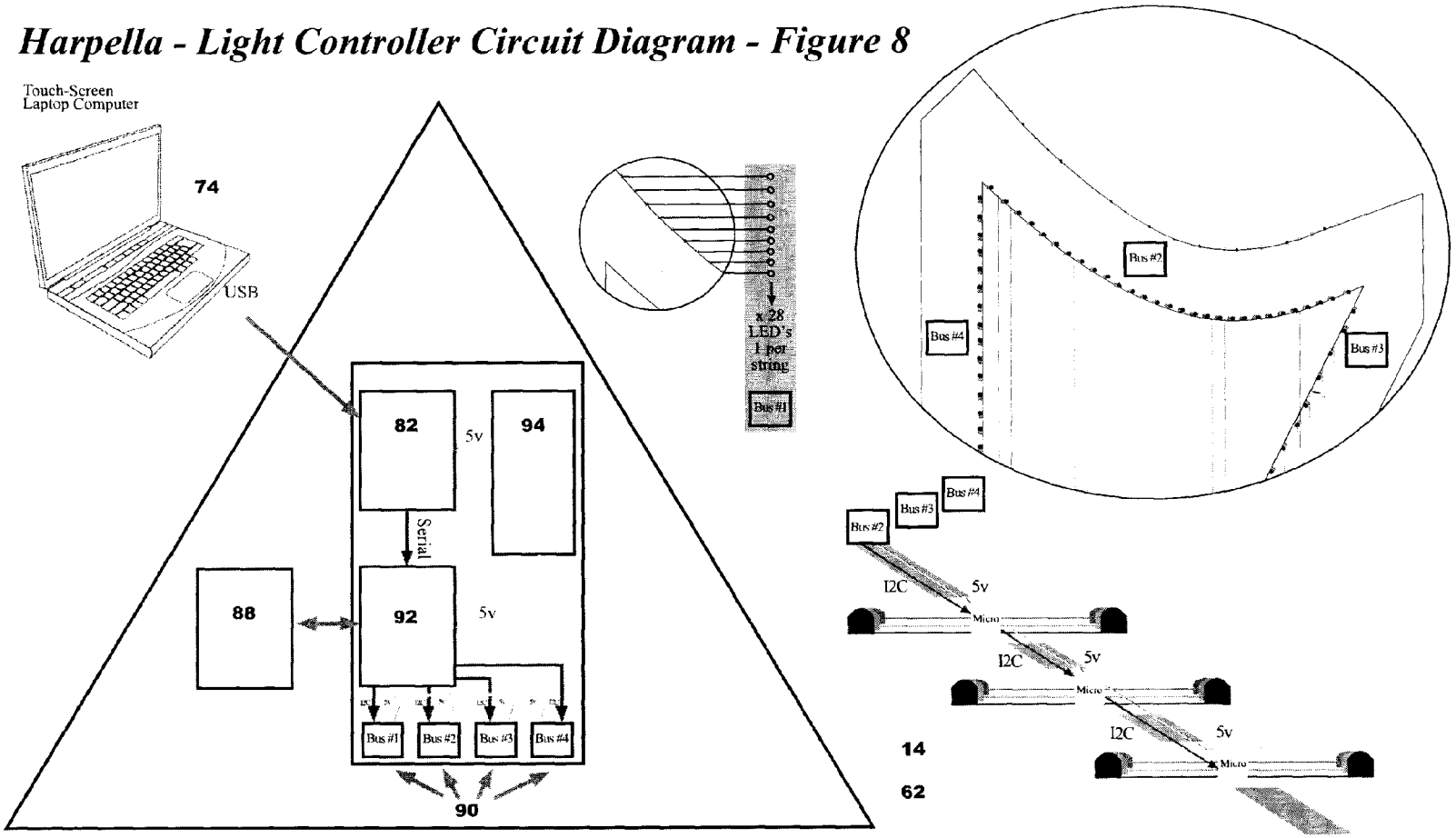
FIG. 8 illustrates a light controller circuit diagram.

FIG. 8 illustrates light controller circuits, according to one embodiment. The light controller circuitry may be a combination of the string light control circuits (62) and the LED control circuits (64). The light controller circuitry may be operatively connected to a plurality of bus elements (90). One bus element, or a set of bus elements may control the lighting of the string lights (18). Other bus elements may control the LEDs located around the perimeter of the body (16) of the harp (10). For example, one bus element (90) could control the LEDs in the harmonic curve area (20), while separate bus elements (90) may control the LEDs at each side wall of the electronic harp.

The bus elements (90) provide power and a serial I2C stream to individually addressed set of LEDs (12) by being operatively connected to the LED control module (92). The control module (92) enables the body (16) of the electronic harp (10) to be lit with any colour or at specific locations. The light controller circuitry (62, 64) further incorporates a voltage regulator (94), which is intended to regulate the voltage being directed to the LEDs (12) and/or string lights (18). The computer (74) may be operatively connected to the light controller circuitry through USB or other connection and may connect to the USB module (82). The USB module may change the signal to a serial signal to transmit the signal to the lights via the LED control module (92). The LED control module (92) may be further connected to the MIDI module (88) which is shared with the audio circuitry of FIG. 7. The MIDI module (88) may also provide a data stream that can activate the string lights (18) and/or the LEDs (12). The module to control the LEDs may be the same as the module to control the string lights or similar modules may be used, one to control the LEDs (12) and another to control the string lights (18).

Figure 9:
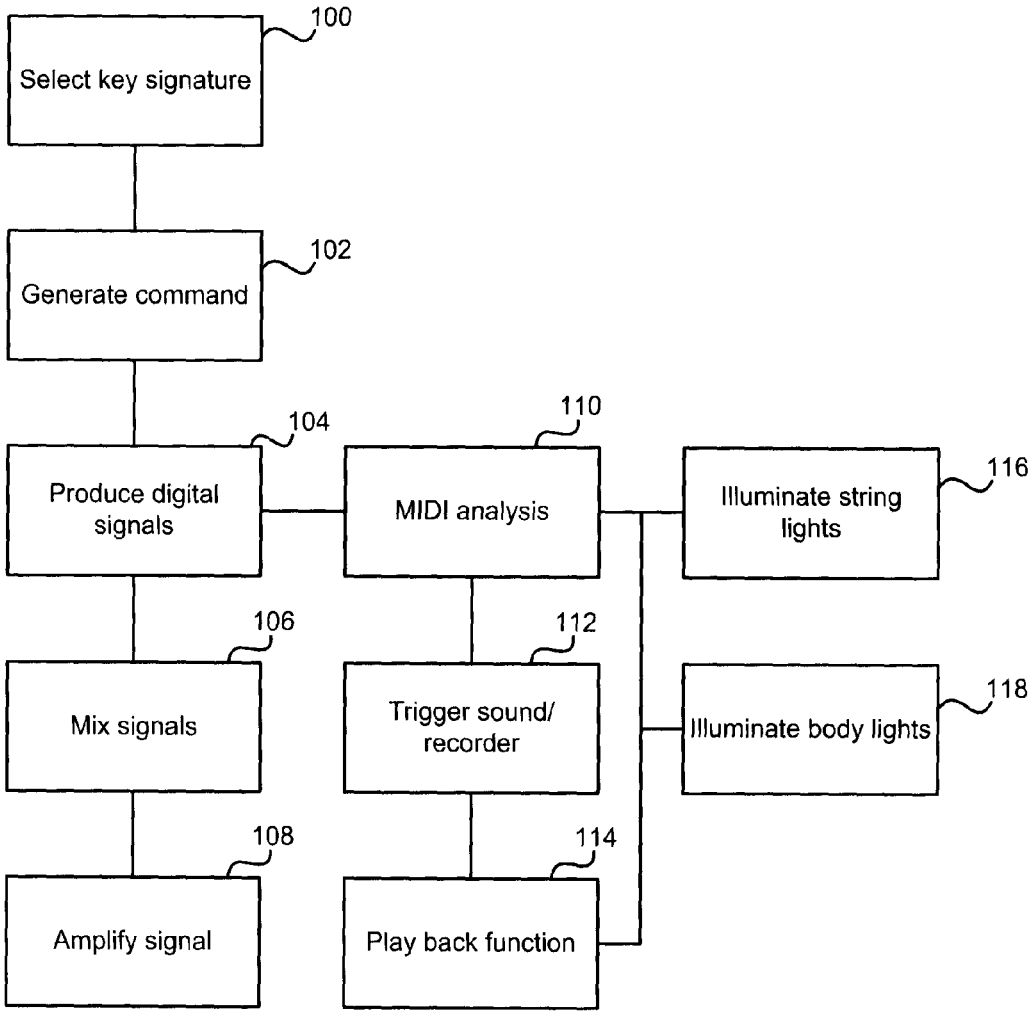
FIG. 9 illustrates, in flow chart form, one operation mode of the electronic harp.

The electronic harp (10) may further including operating modes such as a light mode or an automatic chord mode. The operating modes may make use of the pitch shifting system. One mode of operation, the light mode, is illustrated in FIG. 9. In the light mode the individual strings may increase in brightness when played and create an effect that appears as if the strings are dancing to the music. FIG. 9 illustrates the interaction with the components of the electronic harp (10) in creating possible lighting effects. As described above, when the harpist pluck the strings, the vibration of the strings is registered by the optical pickup (36) and create an analog signal which is amplified by the op amp and converted to a digital signal using the analog to digital circuitry. In the light mode, the harpist selects (100) a key signature. The key signature may be selected by, for example, the foot pedal (72), a touch screen interface or through voice activation via a microphone connected to the computer (74). The key selection may prompt the computer to generate (102) a command and relay the command to the circuitry within the base (52) of the electronic harp (10). The circuitry is configured to take the commands and produce (104) digital signals. The digital signals received may be transposed up or down a semi tone, if required. The circuitry may receive the digital signals that do not need to be transposed depending on the number of sharps or flats required for the key signature selected. Allowing the pitch shifting system to analyze and process the output is intended to ensure that the audio produced is in tune, rendering retuning less necessary than a conventional harp. The digital signals may then be mixed (106) to form a two channel output that is converted back to a stereo analog signal. The analog signal can be amplified (108) through an audio system such as a sound system or headphones. The output may be produced for further channels depending on the audio system and synthesizing used.

The light mode may further interact with the MIDI module (88). The digital signals produced (104) may be analyzed (110) by a MIDI processor within the MIDI module. The MIDI module (88) may assign MIDI note information based on the given key signature. This MIDI note information may be sent to the synthesizer (70) to trigger (112) the synthesizer to play a preconfigured sound or voice. The MIDI note information may be further recorded in a sequencing program to be displayed and/or printed as music notation. The MIDI note information can be played back (114) via a virtual synthesizer that may be a sampled version of the electronic harp (10) to achieve a self-playing function. This self-playing capability is a feature that is intended to be entertaining to watch even without a harpist present. As described below, this same information may trigger the string lights (18) for tutorial applications.

The MIDI note information may also be used to trigger (116) the string lights. As each note is plucked, the string (14) may be illuminated by the corresponding string light (18) for as long as the string is sounding. Once the string attenuation drops below a predetermined threshold level, the light on the string will turn off. Other lengths of time are contemplated, such as lighting the string only for an initial period of time, or not lighting the strings (14) at all. Light mode may also provide for the LEDs (12) or body lights to be illuminated (118). There may be various patterns or functionality mapped to the LEDs (12). In one case, a rainbow like light mode may be activated in which the low and high frequencies of lights are mapped to the low and high frequencies of sound. The light may also be pulsed with the music. Other combinations of colours and lights can be selected and triggered by selecting a given range of frequencies to match between the light and sound. The body lights may also be selected to be independent of the audio and form a single colour or bands of colours which may be controlled by the MIDI note information. This display of light, including the lit strings and the lights of the body of the instrument itself, and sound may provide for entertainment value during a self play mode, without the intention of playing the harp in the conventional manner.

The light mode playback and display may further allow for tutorial applications when learning to play the harp. As each individual note is played back through the computer based module generating the sampled sound of the harp, the corresponding string (14) lights up. When a musical phrase is being played back using the MIDI sequencer program, the music notation can be viewed on the computer screen and the strings will light up indicating which stings should be plucked. This feature is intended to enhance the learning of musical pieces on the harp, particularly due to the fact that a musical composition can be slowed down (without changing pitch). At a slower tempo, the notes and strings can light up at a speed that will enable the student to carefully watch what notes are to be played on each string.

Figure 10:
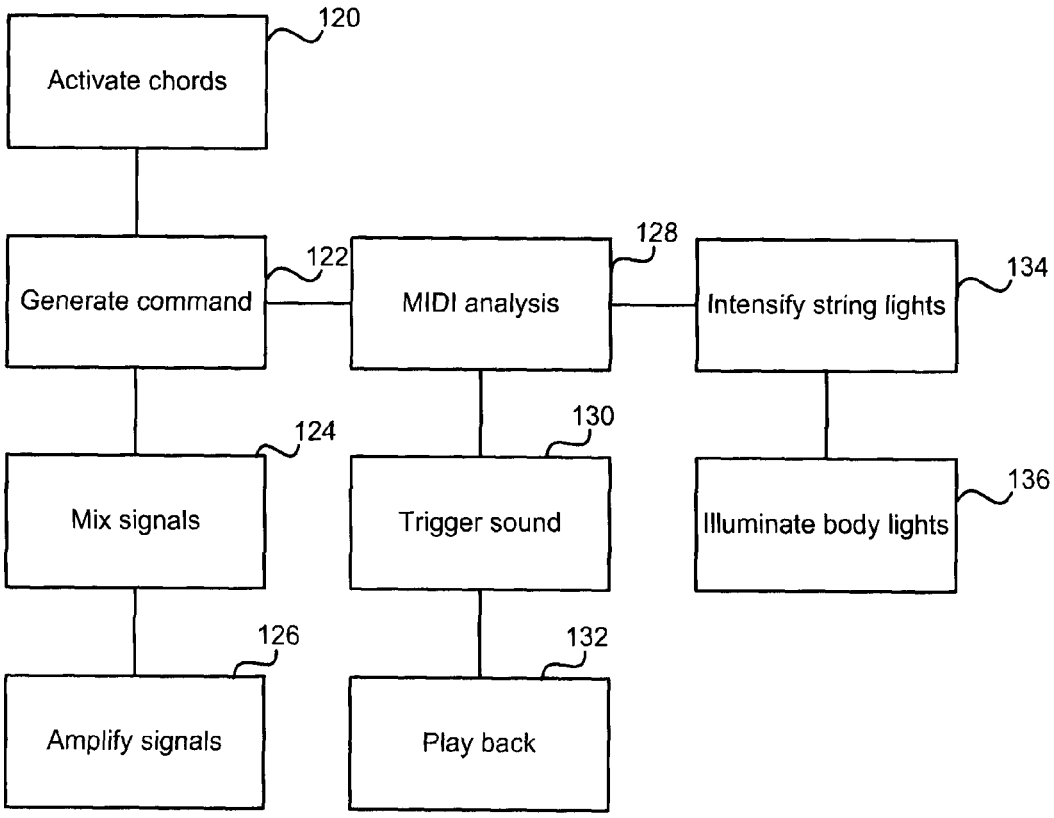
FIG. 10 illustrates, in flow chart form, another operation mode of the electronic harp.

FIG. 10 illustrates the operation of the automatic chord mode. Preset chords or customized chords are activated (120) by selecting a specific set of strings that represent the specific chords. The chords may be selected (120) and activated via the foot pedal (72), by entering the information through a computer through a touch screen or other input mechanism, such as a keyboard or microphone. The chord information may also be changed using MIDI note information via the keyboard or from a sequencer. Once the chords have been activated, the selection prompts the computer (74) to generate (122) a command that tells the processors within the base (52) of the harp (10) to activate only the set of strings (14) and the digital signals from the set of strings that are needed for the specific chord that is activated. The digitals signals may be transposed in pitch as needed.

The digital signals may then be mixed (124) together to form a two channel output that may be converted back to a stereo analog signal. Although reference is made to stereo signal, the signal may be modified to produce an analog signal for more or less channels. The analog signal may be amplified (126) and played through an audio system such as a sound system or headphones.

The automatic chord mode may also interact with the MIDI module (88). When the digital signal is generated it is analyzed (128) in the MIDI processor within the MIDI module (88). MIDI note information is assigned based on the notes used within the selected chord. As in the light mode, MIDI note information may be sent to trigger (130) sound to be played through a synthesizer to play any voice to which the synthesizer has been sent. The MIDI note information may further be recorded to be displayed and/or printed as music notation. The MIDI note information may further be played back (132) from the recording via a virtual synthesizer that may be a sampled version of the harp to achieve a self playing function.

In the automatic chord mode, when the preset chord is initially selected, the string lights (18) may activate only the lights on the set of strings (14) that are active within the active chords. Strings that are not lit may be muted and not heard, even if accidentally plucked. When a string within the set of strings within the preset chord is plucked, the string light may intensify (134). In one case, the string light (18) may intensify for as long as the string is sound, and fade to a less intensified light once the string attenuation drops below a predetermined level. If the harpist does not wish to activate the string lights they may be turned off, as in light mode. The MIDI information may also be used to illuminate (136) the body lights of the harp. As with the light mode, the body lights may be in various combinations of colours.

As the unwanted strings in the automatic chord mode are not heard, it may be easier to play the instrument without the fear of mistaken notes being sounded. In automatic chord mode, a MIDI foot controller may be used to select the actual chord that is desired. Utilizing MIDI note information that can be triggered by a sequencer or the foot controller, the chord can be selected thereby lighting up the strings to be played for the upcoming chord change. The command, however, may not be active until the note off message occurs when the foot is released off the controller or from the sequencer. This again is intended to make playing easier for the beginner harpist to anticipate where their fingers will have to move to when the chord change is to occur. The automatic chord mode is intended to further provide for the well known technique called a "harp gliss" (running the fingers rapidly across the strings up or down) but now the strings can selectively sound only the notes that are desired, for example, major or minor, seventh, diminished chords or even odd tunings.

Figure 11:
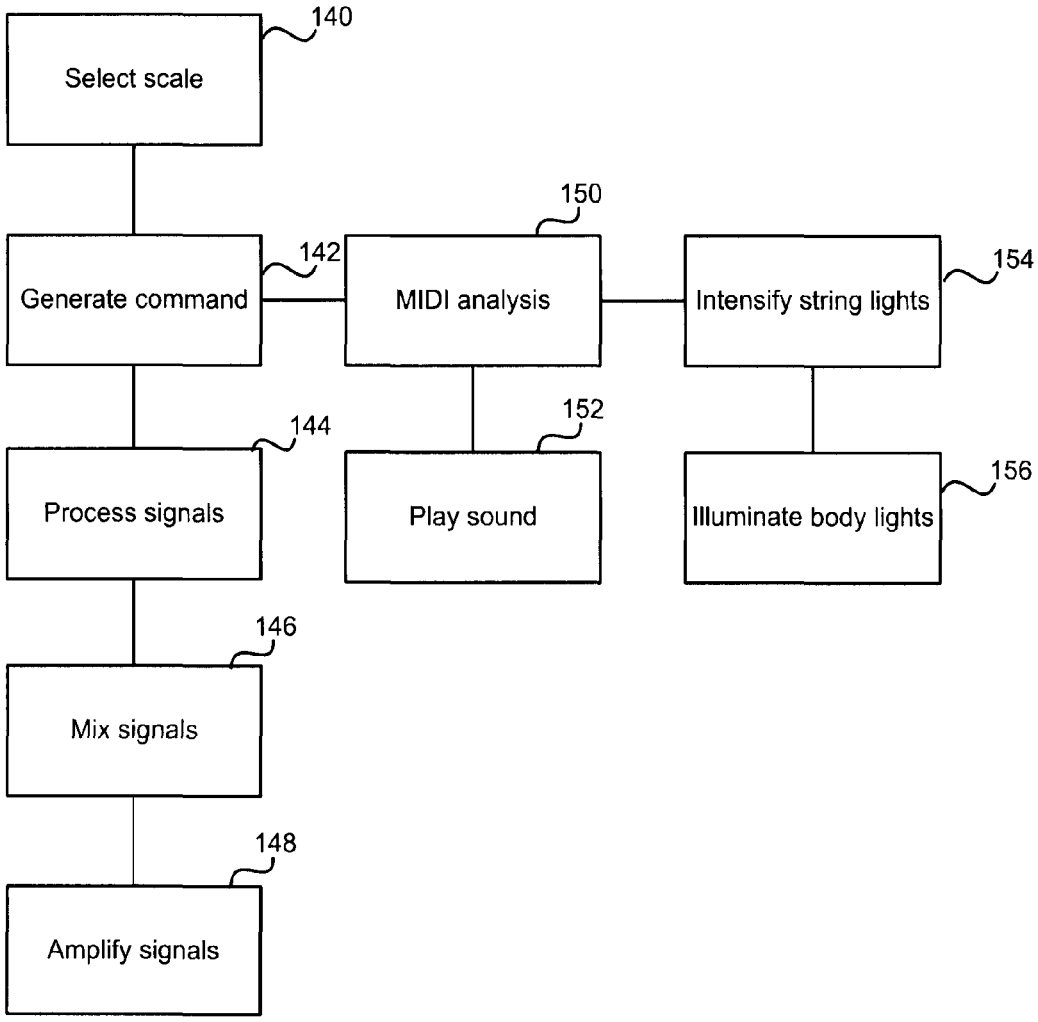
FIG. 11 illustrates, in flow chart form, yet another operation mode of the electronic harp.

Another operating mode is illustrated in FIG. 11. The electronic harp may further include a scale mode that may aid in playing unusual tunings. Much of the light and MIDI functionality used in the light mode may remain the same, however the lighting for specific strings may make it easier to identify certain notes that are active when playing strings as in the case of Pentatonic and Blue Scales where, like in the automatic chord mode, unwanted strings may be muted and not lit. The harpist selects (140) a given preset scale or customized scale. The scale may be selected in a similar matter as selecting a chord. In one case, the scale may be activated during play by selecting the scale through the foot pedal (72) or another input device connected to the computer (74). The selection of the scale prompts the computer to generate (142) a command sent to the base of the harp (10) to process (144) the digital signals. The digital signals may be transposed up or down any desired interval depending on the interval required for the given scale. If the scale uses less than 7 note names or requires certain notes to be skipped, those notes that are note need may be muted. The processing of the digital signals may also assign chromatic or even quarter tone intervals if desired. The digital signals are mixed together (146) and converted to an analog signal, which can be amplified (148) and relayed through an audio output system.

The scale mode also interacts with the MIDI module (88) and the processor within the MIDI module (88) may analyze (150) the digital signal and assign specific MIDI note information to the notes used in the scale. As in light mode, the MIDI note information may be sent to be played (152) through a synthesizer or be recorded. The MIDI note information can be used to enable a play back feature as described above.

Once the preset scale is selected (140), the information may be processed by the MIDI module (88) and the associated MIDI note information may be used to initially light the strings, via the string lights (18) that are active in the selected scale. Strings that are not lit may be muted and not be heard if plucked. As with the automatic chord mode, when an active string is plucked, the string light may intensify (154) during attenuation, and fade when the attenuation drops below a predetermined level. The MIDI note information may further be used to activate (156) the body lights or LEDs (12).

A global transposition module or effects module may also be incorporated in the harp (10). As the pitch of any of the strings (14) may be changed to any pitch desired to accommodate scales and chords, it is possible in the global transposition module to pitch the strings to accommodate any key in any position on the strings. In this configuration, the string lights (18) may use LEDs and the harp may be strung with all white or translucent strings. Using this colour string will make it possible to light the strings any colour so as to indicate the strings that are normally red (indicating the note C) and blue (indicating the note F) at any desired point on the harp. This module may be used as a global function and incorporated into any mode. In the various modes, this module may cause the overall pitch of the strings to rise or fall in a determined interval. This function may be useful as it is intended to pitch the entire range of strings down a full octave (12 semitones) increasing the range of the instrument without adding height and width to the instrument. This function can be selective in that only a certain range of strings could be affected, leaving the rest of the strings unchanged. Only affecting some strings (14) would allow, for instance, for the split point to affect a selected range of strings in the lower end of the harp to allow for bass notes that normally would not be possible on a harp this size. This function is intended to act similar to the transposition function on a MIDI keyboard, making it easy to transpose a musical composition by simply selecting the desired interval on the touch screen interface or other input device.

The global transposition function may be achieved by the giving instructions to the digital sound processors within the DSP module (80) to modify the signal that has been processed. By modifying the digital waveform at this point, transposed up or down a desired interval over a selected range, this pitch effect may be achieved. It is at this point in digital sound processing that the signal can be modified to include special audio effects such as reverberation, digital delay and echo, chorusing, distortion etc.

The electronic harp is intended to be easier to transport than a traditionally harp. The electronic harp, preferably has no bulky sound box and in one case, may measure only 2'×4.5'× 1" allowing the instrument to be carried on an airplane as baggage. Previously, the size of a conventional harp determined the size of the range of the instrument. Using a digital "octave-down" effect in the global transposition module, the electronic harp may be split at any specified point and play a full octave down, extending the range of the harp without adding additional height and width to the instrument This split point can also be changed at the touch of a single control or using MIDI information that can be sent to the harp.

Other size variations may be manufactured to compliment specific markets. A smaller variation with less strings and a correspondingly smaller body may be manufactured to appeal to the younger student. A larger version of the harp with a full complement of strings equivalent to a typical concert pedal harp may also be manufactured. The frame or body, in this variation may be engineered to accommodate the increased number of strings and corresponding increase in frame tension. This model may appeal to harpists who require the full range of strings normally found in compositions typically played in symphonic orchestras. The features offered on these harps can vary, for example, the LED lighting of the body of the instrument, and, in the case of the larger version the "octave-down" pitch module may not be necessary. The pitch shifting system or global transposition module may also be modified to complement the number of strings in use.

In the preceding description, for purposes of explanation, numerous details are set forth in order to provide a thorough understanding of the embodiments. However, it will be apparent to one skilled in the art that these specific details are not required. In other instances, well-known electrical structures and circuits are shown in block diagram form in order not to obscure the understanding. For example, specific details are not provided as to whether the embodiments described herein are implemented as a software routine, hardware circuit, firmware, or a combination thereof.

Embodiments of the disclosure can be represented as a computer program product stored in a machine-readable medium (also referred to as a computer-readable medium, a processor-readable medium, or a computer usable medium having a computer-readable program code embodied therein). The machine-readable medium can be any suitable tangible, non-transitory medium, including magnetic, optical, or electrical storage medium including a diskette, compact disk read only memory (CD-ROM), memory device (volatile or non-volatile), or similar storage mechanism. The machine-readable medium can contain various sets of instructions, code sequences, configuration information, or other data, which, when executed, cause a processor to perform steps in a method according to an embodiment of the disclosure. Those of ordinary skill in the art will appreciate that other instructions and operations necessary to implement the described implementations can also be stored on the machine-readable medium. The instructions stored on the machine-readable medium can be executed by a processor or other suitable processing device, and can interface with circuitry to perform the described tasks.

The above-described embodiments are intended to be examples only. Alterations, modifications and variations can be effected to the particular embodiments by those of skill in the art without departing from the scope, which is defined solely by the claims appended hereto.

What is claimed is:

1. A harp comprising:

a body having a top portion and a lower body;

a set of strings attached to the body, wherein said strings enter a top part of the lower body into a vibration area;

an optical pickup to generate an analog signal produced by the vibration of a string within the set of strings, wherein the optical pickup is mounted within a vibration area within the lower body of the harp;

at least one circuit board to convert the analog signals to a corresponding digital signal;

wherein the digital signal is then processed.

2. The harp of claim 1 wherein the set of strings are lighted, and wherein the lighting for each string is actively controlled by a processor.

3. The harp of claim 2 wherein the set of strings at a lower audio spectrum are lighted with lights in a low end of the visual light spectrum.

4. The harp of claim 2 wherein the set of strings at a higher audio spectrum are lighted with lights in a high end of the visual light spectrum.

5. The harp of claim 1 further including a set of circuit boards.

6. The harp of claim 5 wherein one of the set of circuit boards is for analog to digital conversion.

7. The harp of claim 5 wherein one of the set of circuit boards is for a computer interface circuit.

8. The harp of claim 5 wherein one of the set of circuit boards is for a string light control circuit.

9. The harp of claim 5 wherein one of the set of circuit boards is for a light emitting diode (LED) control circuit.

10. The harp of claim 7 wherein the computer interface circuit receives signals from and transmits signals to a processor for controlling the harp.

11. The harp of claim 10 wherein the signals are Musical Instrument Digital Interface (MIDI) signals.

12. The harp of claim 1 further comprising a pedal for controlling the set of strings.

* * * * *